US006859183B2

(12) United States Patent
Carter et al.

(10) Patent No.: US 6,859,183 B2
(45) Date of Patent: Feb. 22, 2005

(54) SCANNING ANTENNA SYSTEMS

(75) Inventors: Christopher R Carter, Borehamwood (GB); Charles A Rowatt, Borehamwood (GB); Bernard P Gilhespy, Borehamwood (GB); Benjamin D Stephens, Borehamwood (GB)

(73) Assignee: Alenia Marconi Systems Limited, Essex (GB)

( * ) Notice: Subject to any disclaimer, the term of this patent is extended or adjusted under 35 U.S.C. 154(b) by 40 days.

(21) Appl. No.: 10/470,157

(22) PCT Filed: Jan. 15, 2002

(86) PCT No.: PCT/GB02/00126

§ 371 (c)(1),
(2), (4) Date: Jul. 24, 2003

(87) PCT Pub. No.: WO02/065574

PCT Pub. Date: Aug. 22, 2002

(65) Prior Publication Data

US 2004/0056813 A1 Mar. 25, 2004

(30) Foreign Application Priority Data

Feb. 9, 2001 (GB) ..... 0103782

(51) Int. Cl.[7] ..... H01Q 19/06
(52) U.S. Cl. ..... 343/754
(58) Field of Search ..... 343/754, 757, 343/765, 766, 786, 909, 912, 781 P

(56) References Cited

U.S. PATENT DOCUMENTS

| | | | | |
|---|---|---|---|---|
| 3,848,255 A | | 11/1974 | Migdal | |
| 4,042,933 A | | 8/1977 | Lapp | 333/241 |
| 4,044,361 A | | 8/1977 | Yokoi et al. | 343/761 |
| 4,062,018 A | | 12/1977 | Yokoi et al. | 385/147 |
| 4,504,806 A | | 3/1985 | Conn et al. | 343/761 |
| 4,511,868 A | | 4/1985 | Munson et al. | 333/257 |
| 4,749,244 A | | 6/1988 | Luh | 343/754 |
| 5,915,823 A | * | 6/1999 | Simon | 362/551 |
| 6,061,033 A | | 5/2000 | Hulderman et al. | 343/781 CA |
| 6,243,047 B1 | * | 6/2001 | Brown | 343/781 CA |
| 6,366,256 B1 | * | 4/2002 | Ramanujam et al. | 343/781 CA |

FOREIGN PATENT DOCUMENTS

| | | |
|---|---|---|
| GB | 2 115 229 A | 9/1983 |
| WO | 98/47020 A | 10/1998 |

* cited by examiner

*Primary Examiner*—Wilson Lee
*Assistant Examiner*—Huedung X. Cao
(74) *Attorney, Agent, or Firm*—Nixon & Vanderhye P.C.

(57) ABSTRACT

Described herein is a quasi-optic rotating joint (100) which allows circularly polarised radiation to be transmitted therethrough irrespective of the angle of rotation of the joint. The rotating joint (100) comprises a first quasi-optic lens (102) having a first axis (112), which is carried on an inner part (116, 118) of bearings (108, 110) and which shares first axis (112). An outer part (122) of bearing (110) carries a quasi-optic mirror (104) and a second quasi-optic lens (106). The second lens (106) has a second axis (114) which is orthogonal to the first axis (112) of the first lens (102) and which intersects at the mirror (104). A Gaussian beam waist is formed at the mirror (104) by the first lens (102) and the second lens (106) is matched to the reflection of the beam waist at the mirror (104). Circularly polarised Gaussian beams passing through the joint (100) suffer a phase shift of angle Ψ which increases at the same rate as the increase in angle of rotation of the joint (100). If the radiation returns through the joint (100) in the same hand of circular polarisation as it left, the overall phase shift is zero. If the hand of polarisation is swapped on return, the overall rotation dependent phase shift is 2Ψ.

22 Claims, 4 Drawing Sheets

SCANNING ANTENNA SYSTEMS

This application is the US national phase of international application PCT/GB02/00126 filed 15 Jan. 2002, which designated the US.

The present invention relates to improvements in or relating to scanning antenna systems.

1. Technical Field

In designing scanning antenna systems where a swept volume constraint applies, it is highly challenging to maintain beam quality (sidelobe performance and directivity gain) from an antenna when scanning through large angles, typically more than 40°. Moreover, where monopulse tracking is needed, it is difficult to avoid locating a monopulse comparator on gimbal, that is, rotating with the antenna. This arises because monopulse information cannot easily be retrieved off gimbal, on the unscanned chassis or fuselage, without the comparator having performed its signal combining function first. In traditional monopulse systems, the scanned comparator provides three signal channels, namely: sum, azimuth difference, and elevation difference. These are conveyed off gimbal to the unscanned chassis through three separate, single moded, articulated transmission lines. Each channel having two rotating joints, six in total. Each traditional rotating joint has two ports each supports only one transmission line mode to propagate.

2. Disclosure of Invention

Such traditional joints tend to obstruct the antenna scan. They are of a resonant design and it proves challenging to avoid unwanted phase effects over wide frequency bands and wide scan angles.

It is therefore an object of the present invention to provide a scanning antenna system which has uniform beam quality and in which the recovery of monopulse information is achieved by a comparator which is off the gimbal and is fixed to a chassis.

It is a further object of the present invention to provide an antenna arrangement in which the monopulse comparator is off gimbal and only two rotating joints are required to provide the desired tracking information.

In accordance with one aspect of the present invention, there is provided a quasi-optic rotating joint for transmitting circularly polarised radiation comprising:

a first quasi-optic lens having a first axis;

a quasi-optic mirror element on which the first lens forms a Gaussian beam waist;

a second quasi-optic lens having a second axis, the first and second axes being orthogonal to one another and intersecting at the quasi-optic mirror element; and bearing means carrying on one half of it the first lens which is coaxial with the rotation axis of the bearing means, and on the other half, an assembly of the mirror element and the second lens, the assembly being rotatable with respect to the first lens.

The term 'lens' as used herein is intended to mean an element which transforms the phase front curvature of a fundamental Gaussian beam from one value, on one side of the element, to another value on the other side of the element. This transformation is achieved by means of the dielectric property of the element being dissimilar to that of the medium existing outside of that element and by its thickness varying with displacement from the axis of propagation. For example, the dielectric external to the element may be other than air or vacuo. Moreover, the element may itself be air or vacuo.

The term 'lens' is also intended to include one or more lens elements which form a lens group acting as a single lens element.

The term 'quasi-optic' refers to Gaussian beam optics in which the wavelength of the electromagnetic radiation is not sufficiently small to ignore diffraction effects, and the term 'Gaussian beam waist' refers to the effective focus of a 'quasi-optic' beam.

The quasi-optic mirror element may comprise a plane mirror. Alternatively, the quasi-optic mirror element comprises a dichroic beam splitter. The dichroic may comprise a free standing wide grid. Alternatively, the dichroic may comprise an array of metallic dipoles or crossed dipoles printed on a dielectric sheet. In each of these cases, the dichroic deflects by reflection longer wavelength bands, e.g. microwave or radar and transmits shorter wavelength bands, e.g. infra red and visible radiation. As a further alternative, the dichroic may comprise a stack of dielectric sheets tuned to enhance deflection by reflection of shorter wavelengths bands and transmission of longer wavelength bands.

Advantageously, the first and second lenses are located in respective beam pipes. Each beam pipe may be filled with dielectric material, the lenses being defined by void regions with the dielectric-void interfaces being shaped to form Gaussian beam waists in the dielectric material. The term 'void regions' is intended to mean regions comprising air or vacuo.

Preferably, the rotating joint includes a data link for transmitting signals across the rotating joint, the data link comprising a first element located on one side of the joint and a second element located on the other side of the joint. The data link may comprise an inductive link, the first and second elements comprising respective coils each housed in an annulus and which have a fixed mutual inductance. Each annulus or ring may be formed of a ferrite material or soft iron, and each coil is preferably mounted in a groove formed in the annulus or ring. Alternatively, the data link comprises an optical link, the first and second elements comprising respective annuli each having one unsilvered surface which are arranged to face one another across the joint. In either embodiment of the data link, means may be provided to convert electrical signals into the appropriate property for transmission across the joint.

Drive means may also be provided for effecting rotation of the joint.

In accordance with another aspect of the present invention, there is provided a scanning antenna system comprising:

a scanning antenna;

transmitter means for generating signals for transmission by the antenna;

receiver means for processing signals received by the antenna and includes a monopulse comparator; and a feed arrangement for connecting the transmitter means and the receiver means to the scanning antenna;

characterised in that the feed arrangement comprises an articulated arrangement including a pair of quasi-optic rotating joints as described above, and means for providing circularly polarised radiation to each rotating joint.

The term 'feed' is intended to mean a reciprocal path for conveying electromagnetic radiation between the antenna and receiver or transmitter.

Advantageously, the 'feed' has the additional property of allowing monopulse information from the antenna to be recovered by the receiver. By having two quasi-optic rotating joints in the feed arrangement, an articulated feed is provided which enables monopulse information to be recovered for all antenna pointing angles given the knowledge of the angular deflection of each quasi-optic rotating joint forming the feed arrangement.

The transmitter means and the receiver means are preferably fixed with respect to a chassis, and the antenna scans relative to the chassis.

In one embodiment, one quasi-optic rotating joint performs an elevation scan of the antenna and the other quasi-optic rotating joint performs an azimuth scan of the antenna.

In another embodiment, one quasi-optic rotating joint performs a conical scan of the antenna and the other quasi-optic rotating joint performs a scan away from boresight to vary the semi-angle of the conical scan.

Preferably, the quasi-optic rotating joint controlling the semi-angle is driven by means of a counterweight bevel gear which, in turn, is driven by a bevel gear coaxial with the other quasi-optic rotating joint. This enables the semi-angle to be controlled in accordance with the relative angle between the coaxial bevel gear and the other quasi-optic rotating joint.

The other quasi-optic rotating joint controls roll of the antenna.

Alternatively, the quasi-optic rotating joint controlling the semi-angle is driven by a push-rod arrangement attached to an inner part of a ball bearing race, the outer part of the bearing race being connected to drive means. In this case, the semi-angle is controlled by the translational position of the outer part of the bearing race.

By utilising a pair of quasi-optic rotating joints in an antenna feed, the antenna system can be configured to have a small swept volume and use of the available cylindrical aperture can be maximised.

For a better understanding of the present invention, reference will now be made, by way of example only, to the accompanying drawings in which:

BRIEF MODE FOR CARRYING OUT THE INVENTION

Figure 1:
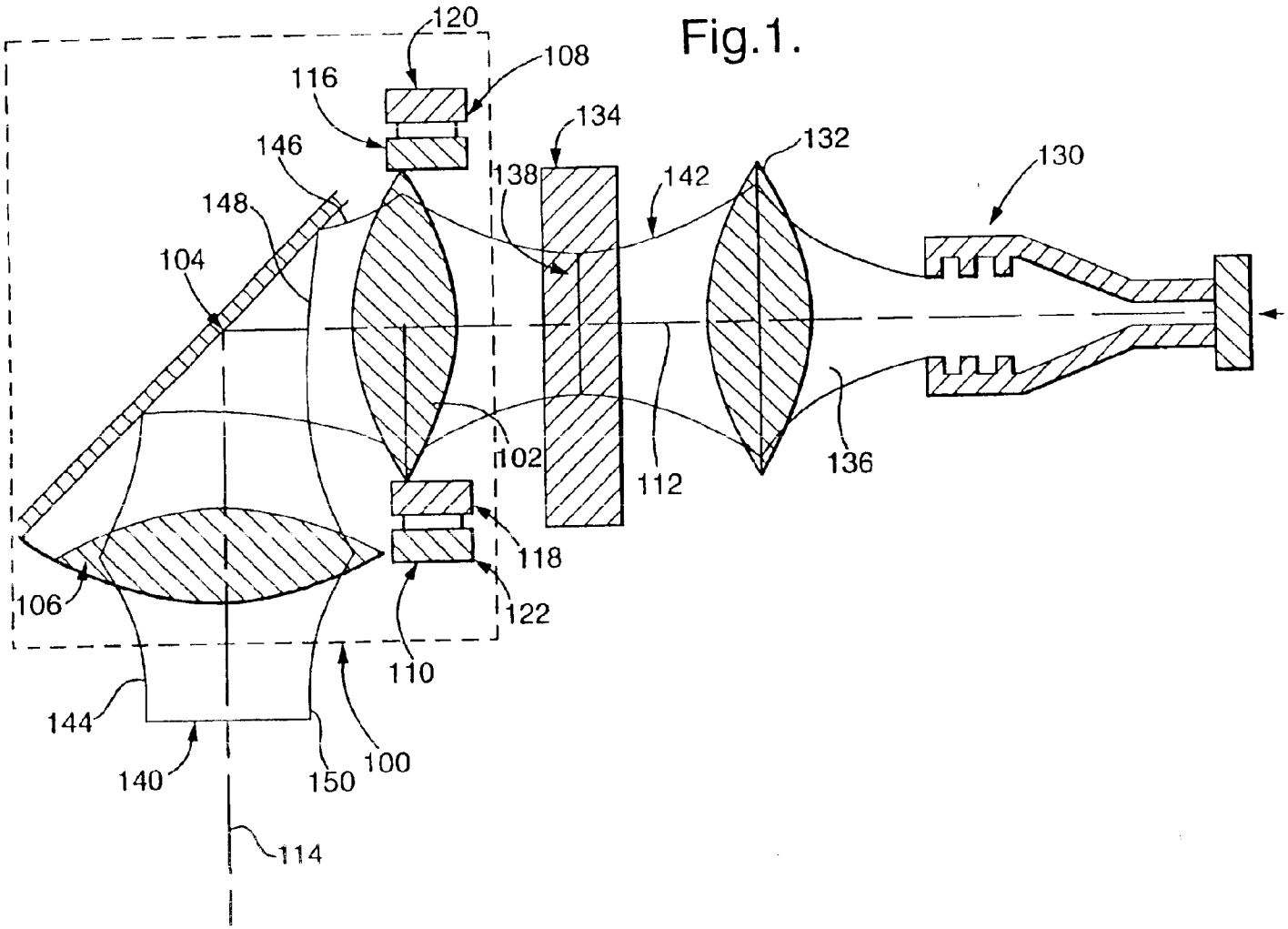
FIG. 1 illustrates an arrangement including a quasi-optic rotating joint in accordance with the present invention.

Referring initially to FIG. 1, a quasi-optic rotating joint 100 is shown. The rotating joint 100 comprises a first quasi-optic lens 102, a quasi-optic plane mirror 104 and a second quasi-optic lens 106. Lens 102 is supported by respective inner parts 116, 118 of races 108, 110 (as shown in more detail in FIG. 2) and lens 106 and mirror 104 are supported by outer part 122 of bearing race 118. Each lens 102, 106 is arranged to have their respective axes 112, 114 orthogonal to one another and intersecting at mirror 104. The lens 106 and mirror 104 form an assembly which rotates as one with respect to the lens 102. Each lens 102, 106 may be mounted in a respective beam pipe (not shown). Moreover, each quasi-optic lens 102, 106 may comprise a quasi-optic lens group, having two or more elements, which functions as a single lens. However, for simplicity, each lens 102, 106 is described as a simple, single quasi-optic lens.

As is also shown in FIG. 1, the rotating joint 100 is connected to a feedhorn 130 which supplies electromagnetic radiation to a further quasi-optic lens 132 and quarter wave plate 134. The feedhorn 130, further lens 132 and wave plate 134 are all connected to be fixed with respect to outer parts 120, 122 of ball bearing races 108, 110 and are therefore rotatable with respect to the lens 102. The feedhorn 130 provides a near quasi-optic beam 136 which is incident on further lens 132. Lens 132 forms a beam waist 138 as shown which is symmetrical about axis 112, the beam waist 138 coinciding with the quarter wave plate 134.

The beam waist 138 provides an input to the rotating joint 100, the joint producing an output as indicated by beam waist 140. As the rotating joint 100 is in effect symmetrical, the beam waists 138, 140 and hence the input and output can be interchanged.

Beam 136 produced by feedhorn 130 may be linearly polarised. Quarter wave plate 134 may be oriented such that the polarisation of beam 136 is changed to a particular circular polarisation which is when input into the rotating joint 100, for example, right hand or left hand circular polarisation.

Beam waists 138, 140 are hypothetical and are formed on respective contours 142, 144 of constant field strength one Neper down on strength at the respective centres of the input and output beams.

In operation, the full arrangement shown in FIG. 1 produces a quasi-optic beam 136 which grows by diffraction until it is incident on lens 102. Lens 102 produces a beam 146 having a beam waist (not shown for clarity) on mirror 104. The mirror 104 reflects the beam 146 by 90° to form a reflected beam 148 which grows by diffraction until it is incident on lens 106. Lens 106 produces an output beam 150 which has beam waist 140. As lens 106 and mirror 104 are connected as a single assembly as described above, as the assembly rotates the beam waist 140 rotates freely therewith.

The quarter wave plate 134 may comprise a quarter wave plate as described in GB-A-2 345 797.

When a circularly polarised beam passes through the quasi-optic rotating joint 100, a phase shift is obtained. If the polarised beam is of right hand circular (RHC) polarisation and propagation is in $a+\bar{k}$ direction, the electric field vector, $\bar{E}$, can be expressed as $$\bar{E}_{RHC} = \mathrm{Re}[E_0(\bar{i} + j\cdot\bar{j})]e^{j(\omega t - \frac{2\pi}{\lambda})} \tag{1}$$

where $\bar{j}$ and $\bar{i}$ are unit vectors in the y and x directions respectively, z is the distance along the $\bar{k}$ vector, $E_o$ is the magnitude of the field strength, j is $\sqrt{-1}$, ω is the angular frequency in radians per second, and t is time.

It is to be noted that "Re" means "the real part of".

The electric field appears to rotate at the RF frequency clockwise when looking along the direction of propagation.

Figure 3:
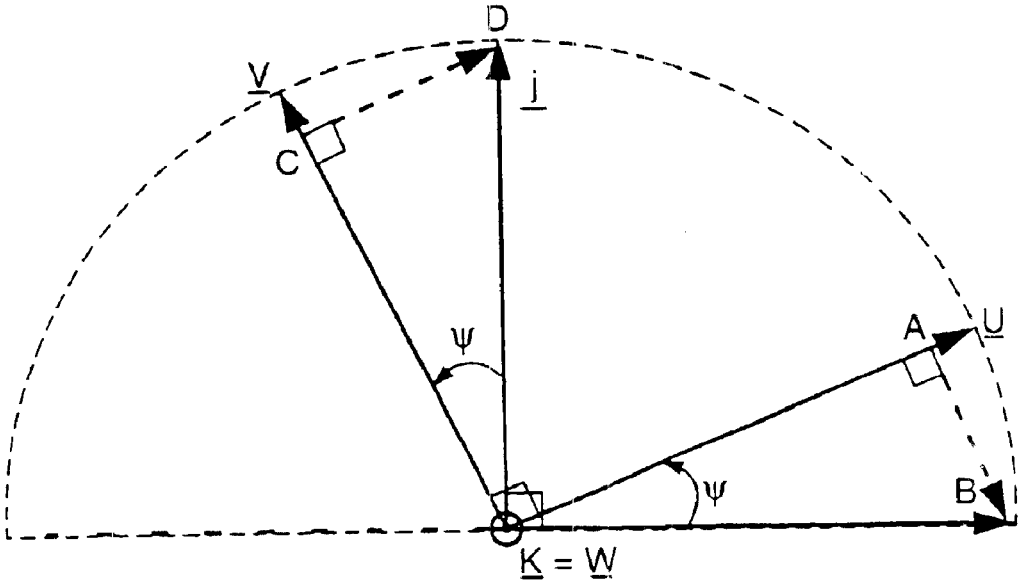
FIG. 3 is a vector diagram illustrating the phase shift obtained across the quasi-optic rotating joint of FIG. 2.

Consider a separate axis set of unit vectors, $\bar{U}$, $\bar{V}$ and $\bar{W}$ where $\bar{W}$ is parallel to $\bar{k}$ but $\bar{U}$ and $\bar{V}$ are rotated anti-clockwise by an angle Ψ with respect to $\bar{i}$ and $\bar{j}$ as shown in FIG. 3. Then triangle (OAB) shows that $$\bar{i}=\bar{U}\cos\Psi-\bar{V}\sin\Psi \tag{2}$$

and triangle (OCD) shows that $$\bar{j}=\bar{V}\cos\Psi+\bar{U}\sin\Psi \tag{3}$$

Substituting for $\bar{i}$ and $\bar{j}$ in equation (1) using equations (2) and (3) gives $$E_{RHC} = \mathrm{Re}[E_0[(\overline{U}\cos\Psi - \overline{V}\sin\Psi) + j(\overline{V}\cos\Psi + \overline{U}\sin\Psi)]]e^{j(\omega t - \frac{2\pi}{\lambda})} \quad (4)$$

$$= \mathrm{Re}[E_0[(\overline{U}\cos\Psi - \overline{V}\sin\Psi) + (j\overline{V}\cos\Psi + j\overline{U}\sin\Psi)]]e^{j(\omega t - \frac{2\pi}{\lambda})}$$

Since j.j=−1, then equation (4) becomes $$E_{RHC} = \mathrm{Re}[E_0[\overline{U}(\cos\Psi + j\sin\Psi) + j\overline{V}(\cos\Psi + j\sin\Psi)]]e^{j(\omega t - \frac{2\pi}{\lambda})} \quad (5)$$

$$= \mathrm{Re}[E_0(\overline{U}\cdot e^{j\Psi} + j\overline{V}\cdot e^{j\Psi})]e^{j(\omega t - \frac{2\pi}{\lambda})}$$

$$= \mathrm{Re}[E_0(\overline{U} + j\overline{V})]e^{j(\omega t - \frac{2\pi}{\lambda} + \Psi)}$$

It is to be noted that equation (5) is now in the same form as equation (1) with an additional phase shift of Ψ.

For left hand circular (LHC) polarisation, $$\overline{E}_{LHC} = \mathrm{Re}[E_0(\overline{i} - j\cdot\overline{j})]e^{j(\omega t - \frac{2\pi}{\lambda})} \quad (6)$$

and using equations (2) and (3) above, it can be shown that $$\overline{E}_{LHC} = \mathrm{Re}[E_0(\overline{U} - j\overline{V})]e^{j(\omega t - \frac{2\pi}{\lambda} - \Psi)} \quad (7)$$

Equation (7) shows that for LHC polarisation there is a negative phase shift of Ψ.

When the quasi-optic rotating joint 100 is used with radar, if the outgoing transmission pulse is RHC polarised, it will be shifted by +Ψ degrees as it passes through the joint. It will be readily appreciated that Ψ increases with the angle of rotation of the quasi-optic rotating joint. If the returning pulse is co-polar, i.e. also RHC polarised, it will again be shifted by Ψ as it passes through the joint 100 but this time the phase shift will be negative as the pulse is travelling in the opposite direction. This means that the overall effect will be zero. However, if the returning pulse is cross-polar, i.e. LHC polarised, then the returning phase shift will be +Ψ. This is because the phase shift will be −Ψ for LHC and then negative again as it is travelling in the negative direction, the double negative causing a positive phase shift (−(−Ψ)) Therefore, the total phase shift is +2Ψ.

Moreover, the transmission phase shift is a function of the rotation angle of the joint. This means that measurement of the phase shift of a returning pulse can provide an indication of the angle of rotation of the quasi-optic rotating joint with respect to fixed components such as the feedhorn 130, lens 132 and quarter wave plate 134 as shown in FIG. 1. The polarisation isolation is also preserved on a round trip as a circularly polarised outgoing pulse returns as a circularly polarised pulse whether of the same hand (co-polar) or other hand (cross-polar). It has also been found that the insertion loss is inherently invariant with respect to the angle of rotation, that is, the loss of an input pulse as it passes through the quasi-optic rotating joint is substantially the same regardless of the angle of rotation, and higher order beam modes can be supported for transmission through the joint which remain in phase register allowing monopulse information to be relayed across the joint.

It will be appreciated that the quasi-optic rotating joint described with reference to FIGS. 1 and 2 may be used with any type of suitable radiation, but the components, that is the lenses and mirror, forming the joint need to be compatible with the type of radiation. For example, if microwave radiation is to be transmitted across the joint, the mirror would comprise a flat metal surface.

Figure 2:
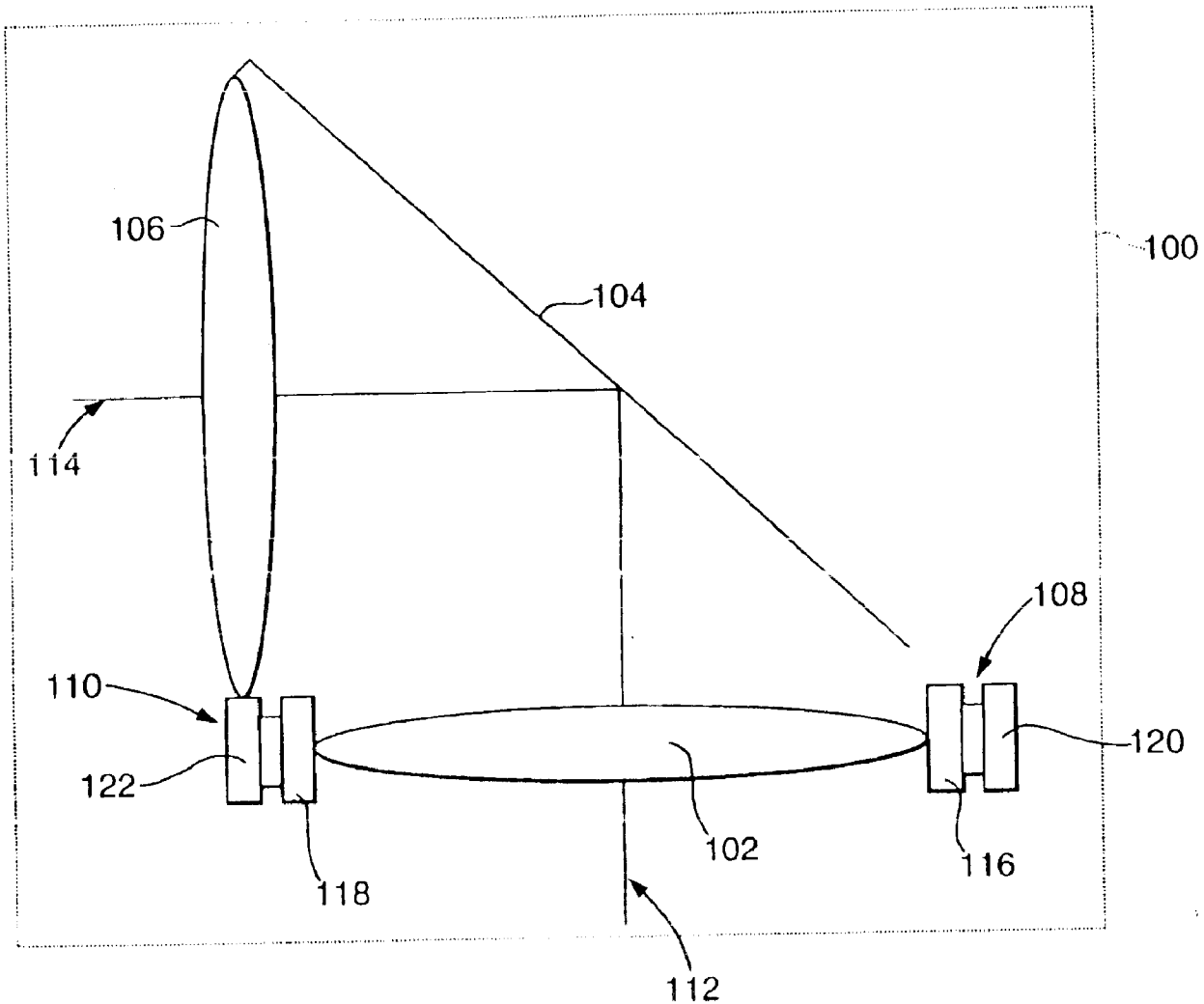
FIG. 2 illustrates the quasi-optic rotating joint of FIG. 1 in more detail.

Furthermore, the mirror 104 as shown in FIGS. 1 and 2 may be replaced by an integral dichroic beam splitter arrangement which allows for feeding common aperture multispectral primary optics with the antenna. The dichroic may comprise a free standing wire grid. The free standing wire grid comprises a frame carrying a first set of parallel wires at regular pitch and a second similar set lying in the same plane but running in the orthogonal sense. The normal of the plane of wires is inclined at 45 degrees to incident radiation axis of propagation. A majority, typically 92%, of the incident millimeter-wave radiation is deflected through 90 degrees by the beam splitter and a minority of the infra red or visible is so deflected. The majority, typically 85%, of incident infra red or visible radiation passes undeflected through the beam splitter. The diameter and pitch of the wires are selected to suit the particular frequency. If the millimeter wave radiation is circular polarised, e.g. RHC, the reflection causes a swap to the opposite hand, e.g. LHC. The beam splitter arrangement allows more than one spectral band of radiation to be transmitted at the same time, different spectral bands being split off and directed to different processing areas so that information carried by each band can be derived. As the beam splitter arrangement lies between two lenses as shown in FIGS. 1 and 2, the lens which is required to transmit all the different spectral bands (the unsplit radiation) is made of a suitable mutually compatible dielectric material.

The dichroic may also be a dielectric sheet having a thickness tuned for transmission of the higher frequency mode, for example, infra red, with printed resonant structures formed thereon. The resonant structures may comprise dipoles or cross dipoles.

The dichroic may also be formed by a single dielectric sheet or stack on dissimilar dielectric sheets which have thicknesses that are tuned for the deflection by reflection of the shorter wavelength band and the transmission of the longer wavelength. Such an arrangement would also be compatible with millimetric wave antenna feeds, and could facilitate simultaneous common aperture operation at millimetric wave and infra red or visible wavelengths.

The embodiment of the quasi-optic rotating joint described with reference to FIGS. 1 and 2 comprises lenses 102, 106 surrounded by air or a vacuum. However, this arrangement can be replaced by a dielectric material which fills the beam pipe with the lens regions left void or filled with air. The term 'beam pipe' refers to regions through which a beam passes. The air-dielectric interfaces then have convex surfaces to the dielectric which provide the beam waists in the dielectric material. As defined above, the term 'lens' means a curved dielectric interface where a phase front curvature is transformed. This means that the dielectric (lenses) and air/vacuum regions can be replaced by air/vacuum (lenses) and dielectric regions. This has the advantage that a highly compact feed can be provided in which the beam pipe can be scaled down by a ratio relating to the refractive index of the dielectric filler material with respect to the air/vacuum-filled beam pipe. For example, if quartz having a relative permittivity of 4 is used as the dielectric, the beam pipe can be scaled down by a half as the scale is related to the square root of the relative permittivity, $\epsilon_r$, of the dielectric.

Furthermore, a very low edge taper can be achieved with respect to an air-filled beam pipe of the same size and allows a reduced feed blockage of an antenna to which such a joint is connected. As will be understood by a person skilled in the art, the term 'edge taper' refers to the power loss in the skirt of the Gaussian beam, and hence a very low edge taper has little power loss. Low feed blockage is favourable because, as the feed is smaller, a larger active area is available on the primary reflector through which the feed passes. This leads to superior beam quality. The dielectric-filled joint has the same advantages as the air vacuum-filled joints.

A rotating inductive transformer link may be provided for carrying signals from one side of a quasi-optic rotating joint to the other. Such a link may comprise two coils each of which is housed in a circumferential groove formed in a soft iron or ferrite annulus or ring. The rings are located on either side of the joint so that they maintain a fixed separation and hence a fixed mutual inductance but can rotate in alignment.

Such a transformer link may carry video signals, gyroscope signals, accelerometer signals and pick off outputs. The link may also be used to provide a.c. power to on gimbal electronics using an appropriate modulator and demodulator. This avoids the use of a wiring loom to connect to the on gimbal electronics for fast angular guidance updates when the joint is used in active radar guided missile seeker heads, for example.

It is also possible to transmit pulse modulated optical data across a quasi-optic rotating joint. Two Perspex (registered trade mark) annuli of square cross section can be used, one annulus being located on each side of the rotating joint. Each annulus is silvered on the inner and outer curved surfaces and on one of the flat surfaces. The unsilvered surface is roughened to give a diffuse appearance. The annuli are arranged such that the unsilvered surfaces face each other but are separated slightly. Each annulus is connected to an optical fibre or other light guide so that optical signals may be introduced into one annulus via the silvered flat surface and optical signals may be extracted from the other annulus via its silvered flat surface.

Digital data which is amplitude modulated on to an optical carrier may be recovered by an optical detector, for example, a photodiode, at all angles of rotation of the joint with a credible bit error rate. Such an optical data link may carry digital or digitised signals, such as video signals, gyroscope signals and accelerometer signals. The optical data link may also provide digitised pick off outputs from on gimbal electronics using an appropriate optical source with suitable modulation and demodulation. Again, the digital optical link removes the necessity for a wiring loom in a similar way to the transformer link described above.

It will readily be appreciated that for the joint to rotate, suitable drive means is provided for driving the assembly of the lens 106 and mirror 104 carried by outer part 122 relative to inner parts 116, 118 of bearings 108, 110.

A quasi-optic rotating joint can be used in an antenna system so that the feed to the antenna can be maintained whilst being able to rotate the antenna itself with respect to the feed. The feed can be defined as a reciprocal path to and from antenna either for transmission ($T_x$) or receiving ($R_x$).

It will readily be understood that the provision of one quasi-optic rotating joint will allow movement of the antenna in one plane through its boresight e.g. either in azimuth or elevation. This may not be adequate in some instances as movement in both azimuth and elevation is required. Alternatively, movement in roll and θ may also be required, where θ is the angle from the boresight, to provide a conical scan. In both cases, a pair of quasi-optic rotating joints are utilised as an articulated feed for the antenna.

Figure 4:
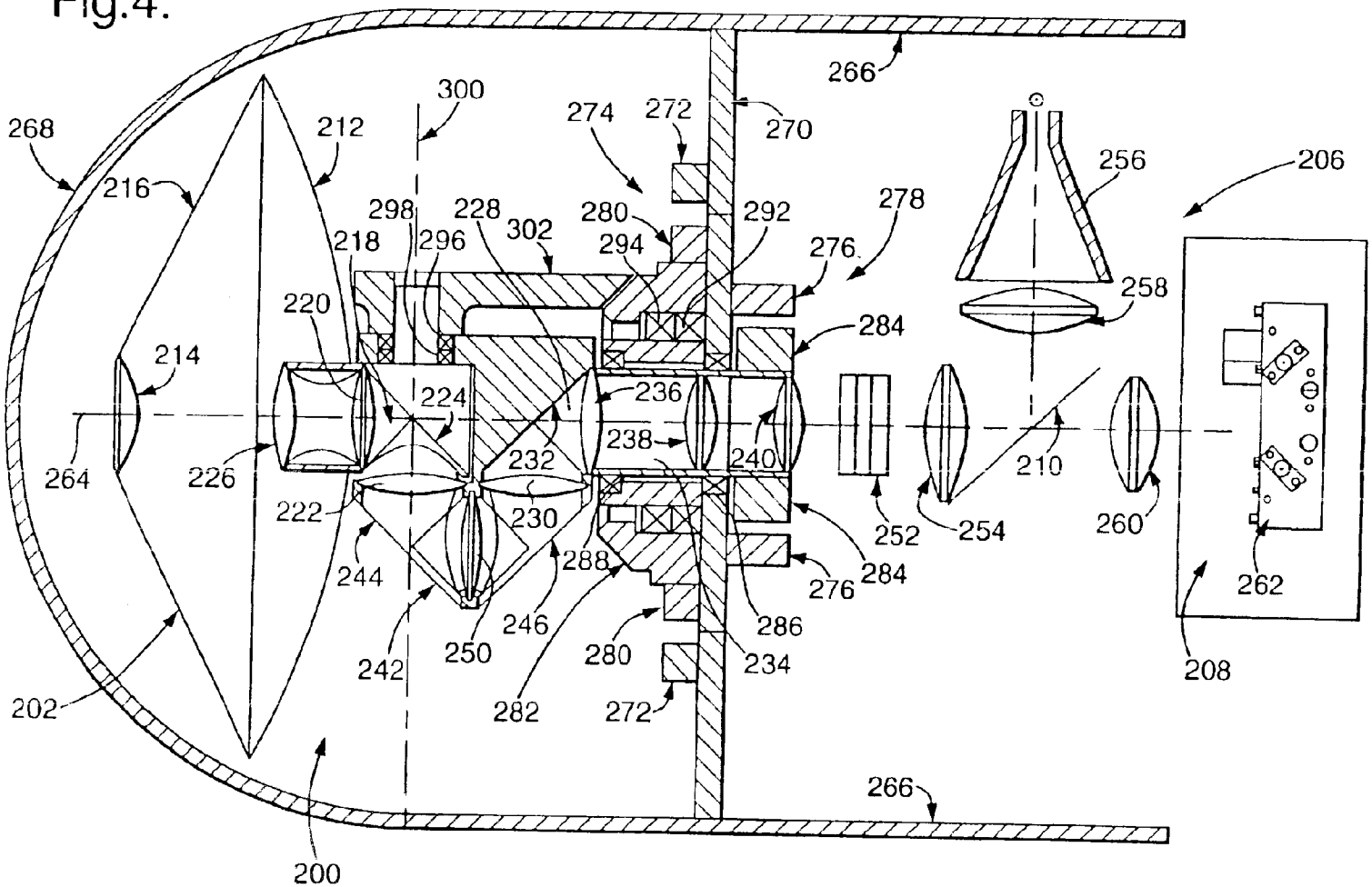
FIG. 4 is a cross-sectional view through an antenna system embodying two quasi-optic rotating joints in accordance with the present invention.

FIG. 4 illustrates an antenna system 200 which provides movement in both roll and θ directions. Although the antenna system is described for use in an active radar guided missile seeker head, it will readily be appreciated that its use is not so limited, and that the antenna system may have other applications.

The antenna system 200 comprises an antenna 202, a feed arrangement 204, a radiation source 206, a receiver circuit 208 and a polarising beam splitter 210. Beam splitter 210 reflects radiation from the radiation source 206 to the feed arrangement 204 and transmits radiation from the feed arrangement to the receiver circuit 208.

The antenna 202 comprises a Cassegrain antenna having a primary reflector 212 and a sub-reflector 214. The sub-reflector 214 is connected to the primary reflector 212 by a support 216.

The feed arrangement 204 comprises a first quasi-optic rotating joint 218 comprising quasi-optic lenses 220, 222 and quasi-optic plane mirror 224 located behind the antenna 202 and arranged to receive radiation from the antenna 202 and to transmit radiation thereto. Quasi-optic lens 226 either transmits the received radiation to the joint 218 (in the receive mode) or receives radiation to be transmitted from the joint 218 (in the transmit mode). The feed arrangement 204 also comprises a second quasi-optic rotating joint 228 which comprises quasi-optic lens 230, quasi-optic mirror 232 and quasi-optic lens group 234. The lens group 234 comprises three separate lens elements 236, 238, 240 as shown. It will readily be appreciated that lenses 220, 222 and 230 may each comprise a lens group in accordance with a particular application. The two joints 218, 234 are connected together via connecting element chain 242 which comprises quasi-optic plane mirrors 244, 246 and quasi-optic coupling lens 250 as shown. It will readily be understood that the connecting element chain 242 may not be required if the feed arrangement 204 is such that the output from one quasi-optic joint can feed directly into the input of the other quasi-optic joint.

A quarter wave plate 252 and a further quasi-optic lens 254 are located between the second joint 228 and the beam splitter 210. The quarter wave plate 252 operates to ensure that circularly polarised radiation passes through the joints 218, 228 so that the phase difference can be determined as described above.

The radiation source 206 comprises a feedhorn 256 and a fixed quasi-optic lens 258. The receiver circuit 208 comprises a quasi-optic lens 260 and a cross-polar receiver 262. In the transmit mode, radiation from the feedhorn 256 is transmitted to antenna 202 via beam splitter 210, lens 254, quarter wave plate 252, joint 228, coupling lens 250, joint 218, and lens 226. Similarly, in the receive mode, radiation received at the antenna 202 is transmitted to the cross-polar receiver 262 via lens 226, joint 218, coupling lens 250, joint 228, quarter wave plate 252, lens 252, beam splitter 210 and lens 260.

The antenna system 200 is shown located on a roll axis 264 of a missile (not shown fully) which comprises a forebody tube 266 and a radome 268. A bulkhead 270 is provided across the bore tube 266 and supports components of the antenna system 200 for rotation. In particular, stator 272 of a first motor 274 and stator 276 of a second motor 278 are mounted on the bulkhead 270. Rotor 280 of motor 274 is mounted on a bevel gear 282 so that energisation of the motor 274 causes the bevel gear to rotate relative to the bulkhead 270. Rotor 284 of motor 278 is connected to beam pipe 286 in which lens group 234 is located so that energisation of the motor 278 causes the second joint 228 to rotate relative to the bulkhead 270.

Bearings 288, 290 are located between beam pipe 286 and the bulkhead 270 to allow the relative rotational movement of the joint 228. Similarly, bearings 292, 294 are located between the bevel gear 282 and the bulkhead 270 to allow relative rotation therebetween. Bearings 296, 298 are also provided on the first joint 218 to allow rotation about θ rotation axis 300. A quadrant bevel gear 302 meshes with bevel gear 282 to provide the rotation about axis 300.

In operation, rotation about the roll axis 264 is obtained when both motors 274, 278 are energised and hence act in combination. Motor 278 provides the main drive for roll with motor 274 providing a compensating drive to maintain the antenna 202 in the correct orientation. Rotation about the θ rotation axis 300 is obtained when there is a differential between the first motor 274 and the second motor 278. This can be achieved either by not energising the second motor 278 whilst energising the first motor 274 or by energising both motors 274, 278 such that there is a differential between the first motor 274 and the second motor 278. It will be appreciated that the first motor 274 provides the main drive for rotation about the θ rotation axis 300.

The sub-reflector support 216 comprises a dielectric material whose thickness is chosen to minimise transmission loss.

Quasi-optic lenses 254, 258 and 260 are fixed with respect to the radome 268 and tube 266. Similarly, polarising beam splitter 210 is also fixed with respect to the radome 268 and tube 266. However, lens 220 and mirror 224 rotate about axis 300 and lens 222, mirror 244, lens 250, mirror 246, lens 230, mirror 232 and lenses 236, 238, 240 rotate about axis 264.

The feedhorn 256 may comprise a waveguide port (not shown) via which a transmitter signal enters the feed arrangement 204 for transmission by the antenna 202 and via which co-polar radiation received at the antenna 202 returns. As described previously, cross-polar radiation is transmitted by the beam splitter 210 to the receiver circuit 208. The cross-polar receiver 262 comprises a microstrip circuit which incorporates patch antennae, a monopulse comparator, down conversion mixers and intermediate frequency (IF) amplifiers. Such a receiver is described in GB-B-2 318 215.

The quadrant bevel gear 302, apart from meshing with bevel gear 282 to provide rotation about the θ rotation axis 300, also acts as a counter-balance for the antenna 202.

It will be understood that the motors 274, 278 form a part of a servo-drive mechanism for pointing the antenna 202 and part of the feed arrangement 204. The mechanism provides one quasi-optic rotating joint 218 which controls the cone semi-angle and which is driven by means of the quadrant bevel gear 302 via the bevel gear 282 which is coaxial with the other quasi-optic rotating joint 234 on the roll axis 264. Thus, the cone semi-angle is controlled by the relative angle of the bevel gear 282 and joint 234.

The mechanism has low inertia and high agility with both motors 274, 278 being fixed relative to the bulkhead 270 off gimbal. This minimises any cross-coupling between the two motors.

Alternatively, the quasi-optic rotating joint 218 which controls the cone semi-angle may be driven by an arm which, in turn, is driven by a push rod attached to a pivot (not shown). The other end of the push rod is attached by means of a pivot to the inner of a ball bearing race which is coaxial with quasi-optic rotating joint 234. The outer part of the ball bearing race can be moved in a controlled manner along the roll axis 264 by means of lead screws synchronised by a toothed belt or cog set (also not shown). In this case, the cone semi-angle is therefore controlled by the translational position of the outer bearing. Such an arrangement provides low torque coupling between the two motors 274, 278.

The use of a pair of quasi-optic rotating joints in accordance with the present invention in an antenna system as described above has the advantage that one joint can be used as an articulated feed and the other joint as a support for a Cassegrain antenna. Rotation of one joint allows the antenna to perform a conical scan whilst the other joint performs a scan away from the boresight to vary the semi-angle of the cone. This provides very efficient use, typically 90%, of the aperture available on a cylindrical airframe as illustrated by bore tube 266 and radome 268. Moreover, high angles of look are achievable, typically 55° away from boresight in any direction, and antenna geometry is not compromised by scanning as the sub-reflector 214 and feed arrangement 204 scan with the primary reflector 212.

Furthermore, rotation axes are suited to the rejection of body roll and the antenna and feed arrangement support dual circular polar reception and two plane monopulse transmission.

If each quasi-optic rotating joint includes a dichroic beam splitter as described above instead of the plane mirror, then a multi-mode antenna system can be provided in which a laser detector or focal plane array (FPA) detector for infra red or visible wavebands can also be utilised.

By using the transformer link or optical link as described above, visible detector output signals, infra red detector signals and pick off signals can be taken across a continuously rotating joint in a continuous conical scan.

The antenna system 200, if combined with a suitable microwave or millimetric transmitter source, local oscillator signals and a transmit/receive duplexer, may form a microwave front end of a radar seeker. The seeker may have the following functionality:

(i) it transmits circular polarised waves, (ii) it supports and down converts dual circular polarisation on receive, (iii) it supports monopulse tracking of cross-polar radar return, (iv) it can scan a conical volume about the boresight (i.e. the roll axis) where that cone has a semi-angle which is greater than 55°, (v) the antenna geometry is invariant to such a scan as is the beam quality in terms of antenna gain and sidelobe levels, (vi) it provides IF output signals, (vii) it supports imaging.

If only elevation and azimuth scanning is required, two quasi-optic joints are used as before. However, rotation of one joint performs an elevation scan of the antenna and the other joint performs an azimuth scan. Whilst high look angles are still achievable, due to the construction in which the joint performing the elevation scan carries the joint performing the azimuth scan, only 45° away from boresight is achievable in any direction. Classical azimuth over elevation gimbal order is obtained which has the advantage of rejecting body motion in these planes.

Again antenna geometry is not compromised by the scanning as the sub-reflector and feed arrangement scan with the primary reflector, and the antenna and feed arrangement supports dual circular polar reception and two plane monopulse transmission. Imaging is also supported as the focal plane can be sampled at at least four positions simultaneously. Furthermore, a multi-mode antenna system can be provided if the plane mirror is replaced by a dichroic beam splitter in at least one rotating joint.

A suitable servo drive mechanism is provided for pointing the antenna and feed arrangement as described above. However, if a radial arm arrangement is used for driving the azimuth axis from a motor mounted on the elevation structure, the arm must clear any fixed structure. Placing the arm just behind the antenna provides more angular clearance but increases the out of balance of the antenna and pushes it forward. If the arm is placed to the rear, the angular movement is only 40° but it counteracts the out of balance.

What is claimed is:

1. A quasi-optic rotating joint for transmitting circularly polarised radiation comprising:

a first quasi-optic lens having a first axis;

quasi-optic mirror element on which the first lens forms a Gaussian beam waist;

a second quasi-optic lens having a second axis, the first and second axes being orthogonal to one another and intersecting at the quasi-optic mirror element; and bearing means carrying on one half of it the first lens which is coaxial with the rotation axis of the bearing means, and on the other half, an assembly of the mirror and the second lens, the assembly being rotatable with respect to the first lens.

2. A rotating joint according to claim 1, wherein the quasi-optic mirror element comprises a plane mirror.

3. A rotating joint according to claim 1, wherein the quasi-optic mirror element comprises a dichroic beam splitter.

4. A rotating joint according to claim 3, wherein the dichroic comprises a free standing wire grid.

5. A rotating joint according to claim 3, wherein the dichroic comprises an array of metallic dipoles or crossed dipoles printed on a dielectric sheet.

6. A rotating joint according to claim 3, wherein the dichroic comprises a stack of dielectric sheets tuned to enhance deflection by reflection at shorter wavelength bands and transmission of longer wavelength bands.

7. A rotating joint according to claim 1, wherein the first and second lens are located in respective beam pipes.

8. A rotating joint according to claim 7, wherein each beam pipe is filled with dielectric material, the lenses being defined by void regions with the dielectric-void interfaces being shaped to form Gaussian beam waists in the dielectric material.

9. A rotating joint according to claim 1, further including a data link for transmitting signals across the rotating joint, the data link comprising a first element located on one side of the joint and a second element located on the other side of the joint.

10. A rotating joint according to claim 9, wherein the data link comprises an inductive link, the first and second elements comprising respective coils each housed in an annulus and which have a fixed mutual inductance.

11. A rotating joint according to claim 9, wherein the data link comprises an optical link, the first and second elements comprising respective translucent annuli each having one silvered surface which are arranged to face one another across the joint.

12. A rotating joint according to claim 10, wherein each annulus is of substantially rectangular cross-section and the silvered surface comprises a flat surface.

13. A rotating joint according to claim 1, wherein the round trip phase shift comparison of circularly polarised radiation provides an indication of the angle of joint rotation.

14. A rotating joint according to any one of the preceding claim 1, further including drive means for effecting rotation of the joint.

15. A scanning antenna system comprising:

a scanning antenna;

transmitter means for generating signals for transmission by the antenna; receiver means for processing signals received by the antenna and includes a monopulse comparator; and a feed arrangement for connecting the transmitter means and the receiver means to the scanning antenna;

characterised in that the feed arrangement comprises an articulated arrangement including a pair of quasi-optic rotating joints according to any one of the preceding claims, and means for providing circularly polarised radiation to each rotating joint.

16. An antenna system according to claim 15, wherein one quasi-optic rotating joint performs an elevation scan of the antenna and the other quasi-optic rotating joint performs an azimuth scan of the antenna.

17. An antenna system according to claim 15, wherein one quasi-optic rotating joint performs a conical scan of the antenna and the other quasi-optic rotating joint performs a scan away from boresight to vary the semi-angle of the conical scan.

18. An antenna system according to claim 17, wherein the quasi-optic rotating joint controlling the semi-angle is driven by means of a counterweight bevel gear which, in turn, is driven by a bevel gear coaxial with the other quasi-optic rotating joint.

19. An antenna system according to claim 18, wherein the semi-angle is controlled by the relative angle of the coaxial bevel gear and the other quasi-optic rotating joint.

20. An antenna system according to claim 18, wherein the other quasi-optic rotating joint controls roll of the antenna.

21. An antenna system according to claim 17, wherein the quasi-optic rotating joint controlling the semi-angle is driven by a push-rod arrangement attached to an inner part of a ball bearing race, the outer part of the bearing race being connected to drive means.

22. An antenna system according to claim 21, wherein the semi-angle is controlled by the position of the outer part of the bearing race.

* * * * *